US009196187B2

(12) United States Patent
Holland et al.

(10) Patent No.: US 9,196,187 B2
(45) Date of Patent: Nov. 24, 2015

(54) SYSTEM AND METHOD OF REDUCING POWER USING A DISPLAY INACTIVE INDICATION

(71) Applicant: Apple Inc., Cupertino, CA (US)

(72) Inventors: Peter F. Holland, Los Gatos, CA (US); Craig M. Okruhlica, San Jose, CA (US)

(73) Assignee: Apple Inc., Cupertino, CA (US)

( * ) Notice: Subject to any disclaimer, the term of this patent is extended or adjusted under 35 U.S.C. 154(b) by 114 days.

(21) Appl. No.: 14/247,373

(22) Filed: Apr. 8, 2014

(65) Prior Publication Data

US 2015/0287351 A1 Oct. 8, 2015

(51) Int. Cl.
*G09G 3/20* (2006.01)

(52) U.S. Cl.
CPC ..... *G09G 3/20* (2013.01); *G09G 2330/022* (2013.01); *G09G 2360/08* (2013.01); *G09G 2360/14* (2013.01)

(58) Field of Classification Search
CPC ..... G06F 1/3218
See application file for complete search history.

(56) References Cited

U.S. PATENT DOCUMENTS

| | | | | |
|---|---|---|---|---|
| 8,207,934 | B2 | 6/2012 | Plut | |
| 2005/0104802 | A1 * | 5/2005 | Hebert | A61B 19/52 345/7 |
| 2009/0094471 | A1 * | 4/2009 | Choi | G06F 1/3218 713/320 |
| 2012/0254645 | A1 | 10/2012 | Jeganathan et al. | |
| 2013/0054998 | A1 | 2/2013 | Wyatt et al. | |
| 2013/0145107 | A1 | 6/2013 | Sadowski et al. | |

* cited by examiner

*Primary Examiner* — Gerald Johnson
(74) *Attorney, Agent, or Firm* — Meyertons, Hood, Kivlin, Kowert & Goetzel, P.C.; Lawrence J. Merkel

(57) ABSTRACT

A system includes one or more video processing components and a display processing unit. The display processing unit may include one or more processing pipelines that generate read requests to fetch stored pixel data from a memory for subsequent display on a display unit. The display processing unit may also include a timing control unit that may generate an indication that indicates that the display unit will enter an inactive state. In response to receiving the indication, one or more of the video processing components may enter a low power state.

20 Claims, 4 Drawing Sheets

SYSTEM AND METHOD OF REDUCING POWER USING A DISPLAY INACTIVE INDICATION

BACKGROUND

1. Technical Field

This disclosure relates to computer display systems, and more particularly to power management and bus scheduling.

2. Description of the Related Art

Digital systems of various types often include, or are connected to, a display for the user to interact with the device. The display may be external or it may be incorporated into the device. The display provides a visual interface that the user can view to interact with the system and applications executing on the system. In some cases (e.g., touchscreens), the display also provides a user interface to input to the system.

Modern display devices have evolved from cathode ray tubes that used electron guns to illuminate phosphor-coated screens by scanning across the screen horizontally from one side to the other and vertically from top to bottom in a raster to display a frame of information. When the beam reached the bottom of the screen, it needed time to start a new frame at the top. This time interval is referred to as the vertical blanking interval (VBI). During the VBI received data is not actually displayed. Modern displays have no need of the VBI, but display processing components still provide it for backward compatibility. Accordingly, because data is not displayed during the VBI, some display components take advantage of this time period and may go to an inactive state to save power. However, in many conventional low power systems, additional power reductions may be forfeited due to lack of coordination between display components and other system components.

SUMMARY OF THE EMBODIMENTS

Various embodiments of a system and method of reducing power using a display inactive indication are disclosed. Broadly speaking, a display processing system includes one or more video processing components such as a video decoder, for example, and a display processing unit. The display processing unit may include a timing control unit that may generate an indication that indicates that a display unit will enter an inactive state, such as for example, during a vertical blanking interval. In response to receiving the indication one or more of the video processing components may enter a low power state. In this way, it may be possible to improve power consumption.

In one embodiment, a system includes one or more video processing components and a display processing unit. The display processing unit may include one or more processing pipelines that generate read requests to fetch stored pixel data from a memory for subsequent display on a display unit. The display processing unit may also include a timing control unit that may generate an indication that indicates that the display unit will enter an inactive state. In response to receiving the indication, one or more of the video processing components may enter a low power state.

In one specific implementation, the indication indicates that the display will enter the inactive state within a predetermined amount of time. While in another implementation, the indication indicates that the display will enter the inactive state within a predetermined number of lines of a display data frame.

Figure 1:
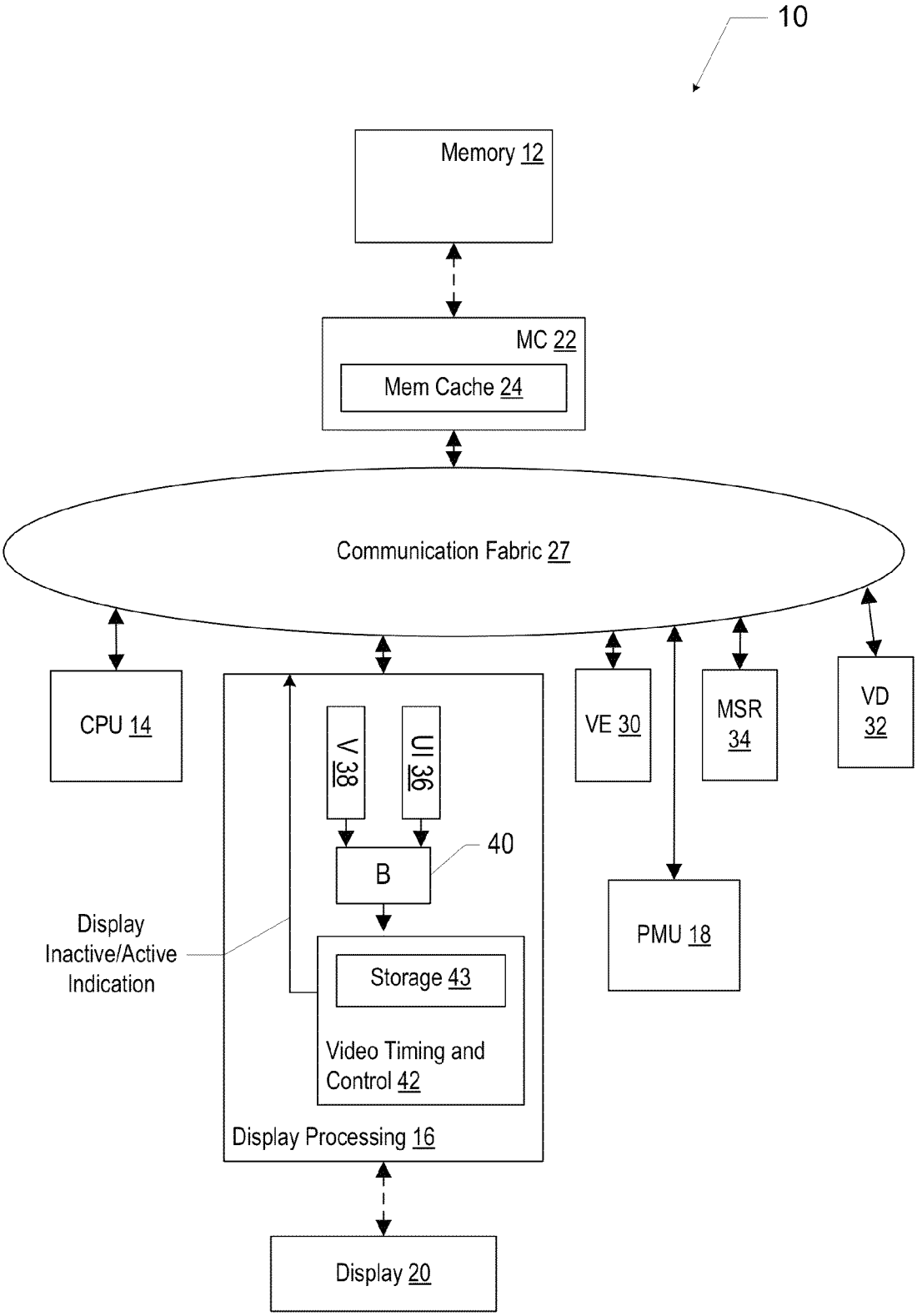
FIG. 1 is a block diagram of one embodiment of a processing system.

Specific embodiments are shown by way of example in the drawings and will herein be described in detail. It should be understood, however, that the drawings and detailed description are not intended to limit the claims to the particular embodiments disclosed, even where only a single embodiment is described with respect to a particular feature. On the contrary, the intention is to cover all modifications, equivalents and alternatives that would be apparent to a person skilled in the art having the benefit of this disclosure. Examples of features provided in the disclosure are intended to be illustrative rather than restrictive unless stated otherwise.

As used throughout this application, the word "may" is used in a permissive sense (i.e., meaning having the potential to), rather than the mandatory sense (i.e., meaning must). Similarly, the words "include," "including," and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. §112, paragraph six, interpretation for that unit/circuit/component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION

Turning now to FIG. 1, a block diagram of one embodiment of a processing system 10 is shown. In the illustrated embodiment, the processing system 10 includes a central processing unit (CPU) 14, a display processing unit 16, a power management unit (PMU) 18, a video encoder 30, a memory scaler/rotator (MSR) 34, a video decoder 32, and a memory controller 22, all interconnected by a communication fabric 27. The memory controller 22 is also shown coupled to a memory 12 during use. In addition, the display processing unit 16 is shown coupled to a display 20. In one embodiment, one or more of the components of the processing system 10 may be integrated onto a single semiconductor substrate as an integrated circuit (IC) "chip." Such systems are often referred to as a system on a chip (SOC). In other embodiments, the components may be implemented on two or more discrete chips.

In one embodiment, the CPU 14 may serve as the CPU of the processing system 10. The CPU 14 may include one or more processor cores and may execute operating system software as well as application software to realize the desired functionality of the system. The application software may provide user functionality, and may rely on the operating system for lower level device control. Accordingly, the CPU 14 may also be referred to as an application processor. It is noted that although not shown in FIG. 1, the CPU 14 may include other hardware such as an interface to the other components of the system (e.g., an interface to the communication fabric 27).

The video encoder 30 may be configured to encode video frames, thereby providing an encoded result. Encoding the frame may include compressing the frame, for example, using any desired encoding or video compression algorithm such as H.264 encoding HEVC encoding, MPEG encoding, H.261 encoding, H.262 encoding, and/or H.263 encoding schemes may be used. The video encoder 30 may write the encoded result to the memory 12 for subsequent use.

The video decoder 32 may generate read accesses to memory 12 to decode frames that have been encoded using any of a variety of encoding and/or compression algorithms. In one embodiment, the video decoder 32 may decode frames encoded with such as H.264, HEVC, MPEG, H.261, H.262, and/or H.263 encoding, or others as desired.

The MSR 34 may perform scaling and/or rotation on a frame stored within memory 12, and write the resulting frame back to memory 12. Thus, the MSR 34 may be referred to as a memory to memory pixel processing unit. The MSR 34 may be used to offload operations that might otherwise be performed in a graphics processing unit (GPU), and may be more power-efficient than a GPU for such operations.

Although not shown for simplicity, the processing system 10 may also include peripheral components such as cameras, GPUs, microphones, speakers, interfaces to microphones and speakers, audio processors, digital signal processors, mixers, etc. These peripherals may include interface controllers for various interfaces external to the processing system 10 including interfaces such as Universal Serial Bus (USB), peripheral component interconnect (PCI) including PCI Express (PCIe), serial and parallel ports, etc. The peripherals may also include networking peripherals such as media access controllers (MACs).

The memory controller 22 may generally include circuitry for receiving memory operations from the other components of the processing system 10 and for accessing the memory 12 to complete the memory operations. In one embodiment, the memory 12 may be representative of any memory in the random access memory (RAM) family of devices. More particularly, memory 12 may be implemented in static RAM (SRAM), or any RAM in the dynamic RAM (DRAM) family such as synchronous DRAM (SDRAM) including double data rate (DDR, DDR2, DDR3, etc.) DRAM. In some embodiments, low power/mobile versions of the DDR DRAM may be supported (e.g. LPDDR, mDDR, etc.). In on embodiment, the memory controller 22 may include various queues for buffering memory operations, data for the operations, etc., and the circuitry to sequence the operations and access the memory 12 according to the interface (not shown) defined for the memory 12.

In the illustrated embodiment, the memory controller 22 includes a memory cache 24. The memory cache 24 may store data that has been recently read from and/or written to the memory 12. The memory controller 22 may check the memory cache 24 prior to initiating access to the memory 12 to reduce memory access latency. Power consumption on the memory interface to the memory 12 may be reduced to the extent that memory cache hits are detected (or to the extent that memory cache allocates are performed for write operations). Additionally, latency for accesses that are memory cache hits may be reduced as compared to accesses to the memory 12, in some embodiments.

In various embodiments, the communication fabric 27 may be representative of any of a variety of communication interconnects and may use any protocol for communicating among the components of the processing system 10. The communication fabric 27 may be bus-based, including shared bus configurations, cross bar configurations, and hierarchical buses with bridges. The communication fabric 27 may also be packet-based, and may be hierarchical with bridges, cross bar, point-to-point, or other interconnects.

It is noted that the display 20 may be any type of visual display devices. For example, the display 20 may be representative of a liquid crystal display (LCD), light emitting diode (LED) display, plasma display, cathode ray tube (CRT), etc. In addition, the display 20 may also be a touch screen style display such as those used in mobile devices such as smart phones, tablets, and the like. The display 20 may be integrated into a system (e.g., a smart phone or tablet) that includes the processing system 10 and/or may be a separately housed device such as a computer monitor, television, or other device. The display 20 may also connected to the processing system 10 over a network (wired or wirelessly).

In one embodiment, the display processing unit 16 (or more briefly referred to as the display pipe) may include hardware to process one or more still images and/or one or more video sequences for display on the display 20. Generally, for each source still image or video sequence, a video pipeline 38 within the display processing unit 16 may be configured to generate read memory operations to read the data representing the frame/video sequence from the memory 12 through the memory controller 22. The display processing unit 16 may be configured to perform any type of processing on the image data (still images, video sequences, etc.). In one embodiment, the display processing unit 16 may be configured to scale still images and to dither, scale, and/or perform color space conversion on the frames of a video sequence using, for example, a user interface pipeline 36. The display processing unit 16 may be configured to blend the still image frames and the video sequence frames to produce output frames for display on displays 20 through a blending unit 40. It is noted that display processing unit 16 may include many other components to process the still images and video streams. These components have been omitted here for brevity.

In some embodiments, the display processing unit 16 may provide various control/data signals to the display, including timing signals such as one or more clocks and/or the vertical blanking interval and horizontal blanking interval control signals. The clocks may include the pixel clock indicating that a pixel is being transmitted. The data signals may include color signals such as red, green, and blue, for example. The display processing unit 16 may control the display 20 in real-time, providing the data indicating the pixels to be displayed as the display is displaying the image indicated by the frame.

In one embodiment the display processing unit 16 may also provide an indication that the vertical blanking interval is about to begin, and as such the display is about to enter an inactive state. This indication may be used by other components such as the communication fabric 27, the PMU 18, the video decoder 32, and the memory controller 22, among others to schedule operations and to reduce power consumption. More particularly, as mentioned above, timing circuits within the display processing unit 16 may generate signals corresponding to the vertical blanking interval. For example, when the pixel data for an entire frame has been processed and displayed, the vertical blanking interval may begin for the display 20, during which time, no data frames are displayed and no pixel data is fetched from memory. As such, in one embodiment, one or more portions of the display processing unit 16 may be placed into a low power state or power gated (e.g., turned off) or clock gated to conserve power. However, because other components may not enter a low power state during this display inactive period, power consumption may not be as low as it could be. Accordingly, the video timing and control unit 42 may generate and provide a display inactive indication that indicates that the display will be entering the vertical blanking interval within a predetermined amount of time that may correspond to a predetermined number of lines. The same or a different indication may also indicate that the vertical blanking interval is coming to an end and thus the display will be leaving the inactive state. Components that receive the indication may use it to power down (i.e., power gate), stop clocks (i.e., clock gate) and become inactive, or otherwise enter an inactive or low power state while the display is inactive and the display processing unit is not fetching pixel data from memory.

In various embodiments, in response to receiving the indication, components that may be running background processes that are not time critical may go inactive or power down. In addition, reducing or eliminating traffic on the communication fabric 27 may also reduce power consumption. Accordingly, components may refrain from initiating bus transactions on the communication fabric 27 during the display inactive period and/or go inactive in response to receiving the indication. Indeed any component that is running background or non-time critical operations may go inactive or into a low-power state in response to receiving the indication. More particularly, in one embodiment, in response to receiving the indication the video decoder 32 may finish processing a current configuration, and then notify the PMU 18. The PMU 18 may then power down the video decoder 32. Alternatively, the PMU may cause one or more clocks to stop within the video decoder 32. In either case, the video decoder 32 may go inactive or power down, and thus no new configurations may be started after receiving the indication.

As the vertical blanking interval is coming to an end, the video timing and control unit 42 may generate another indication that the display will become active within some predetermined and programmable amount of time. This indication may serve as a wakeup to those components that were inactive. In one embodiment the signal may be generated to allow enough time to prepare pixel data for display in the next frame.

Figure 2:
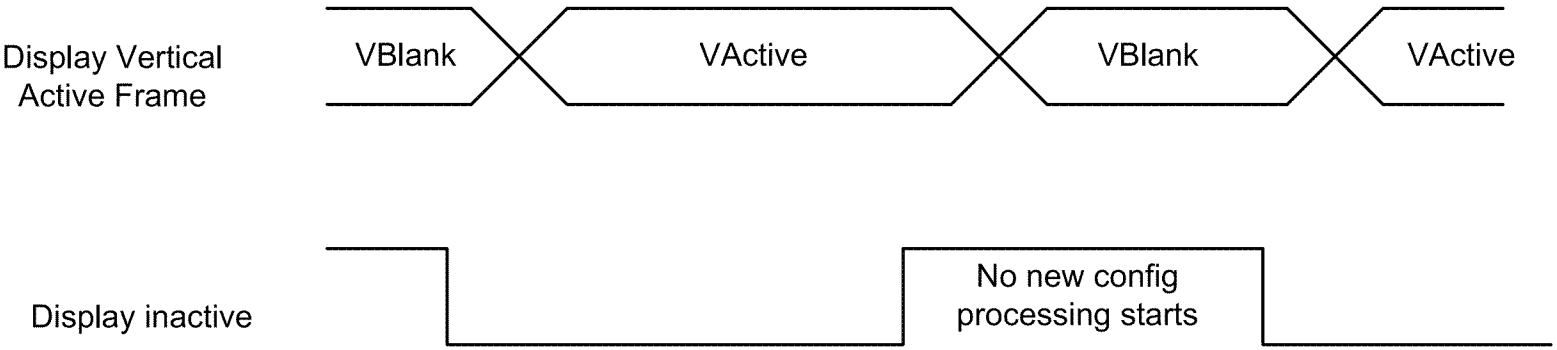
FIG. 2 is a timing diagram describing operational timing aspects of one embodiment of the display processing unit of FIG. 1.

In various embodiments, the video timing and control unit 42 may generate the display inactive indication using any of a variety of signaling mechanisms. For example, as shown in FIG. 2, the display inactive indication is shown as a single signal. As shown, the display inactive indication is an active high signal that is asserted to a logic high level when the display processing is about to become inactive and is entering the vertical blanking interval, and de-asserted when the display processing is about to become active and is exiting the vertical blanking interval. However, it is contemplated that in other embodiments, the display inactive indication may be an active low signal that is asserted to a low logic level when the display processing is about to become inactive and is entering the vertical blanking interval, and de-asserted to an logic high level when the display processing is about to become active and is exiting the vertical blanking interval. The video timing and control unit 42 may be programmable such that the display inactive indication assertion and deassertion timing may be programmed to match system timing. In one embodiment, the video timing and control unit 42 includes a programmable storage 43. The video timing and control unit 42 may use configuration values stored therein to generate the timing and the indication.

Figure 3:
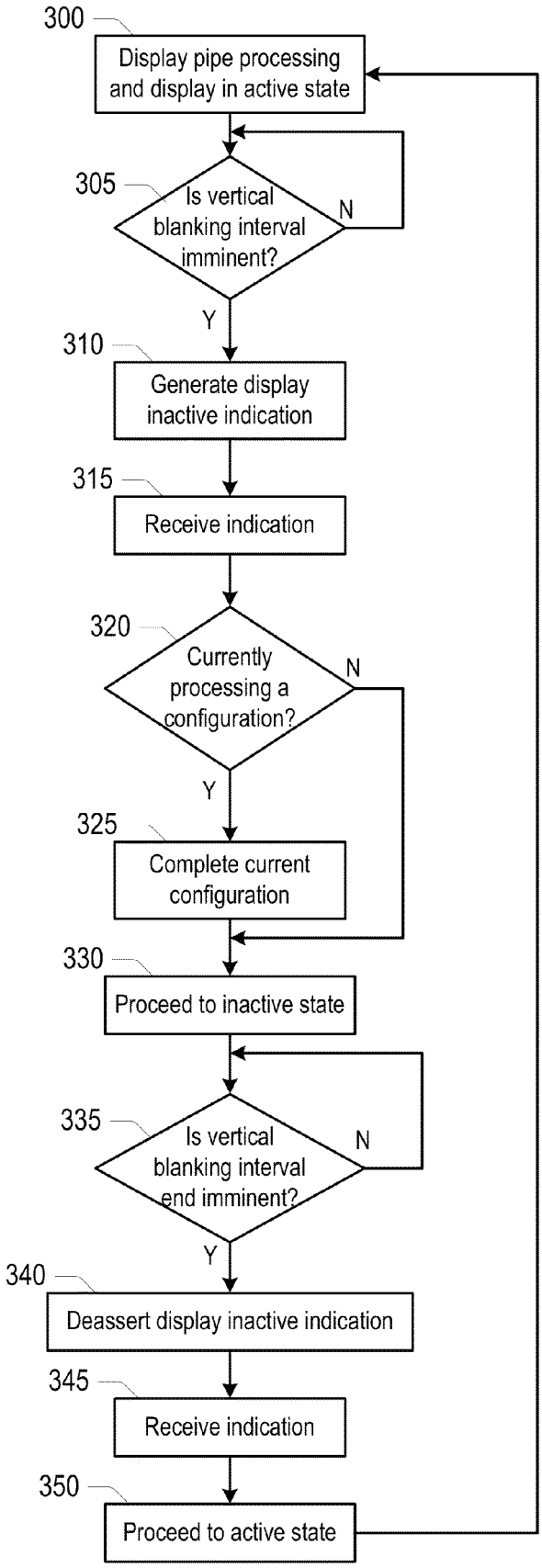
FIG. 3 is a flow diagram describing operational aspects of the display processing unit of FIG. 1.

In FIG. 3, a flow diagram describing operational aspects of the display processing unit of FIG. 1 is shown. Referring collectively to FIG. 1 through FIG. 3 and beginning in block 300 of FIG. 3, the display processing unit 16 is processing frames and the display is in an active state or interval. As the display unit 20 starts to consume all of the frame data, and the vertical blanking interval is imminent (block 305), the video timing and control unit 42 may generate a display inactive indication (block 310). More particularly, in one embodiment, the video timing and control unit 42 may keep track of how many lines have been processed in the frame. When the number of lines remaining reaches a predetermined number, the video timing and control unit 42 may generate the indication. The predetermined number may be programmed into storage 43, for example. In another embodiment, the video timing and control unit 42 may keep track of how much time remains in the active interval. When the amount of time remaining reaches a predetermined value, the video timing and control unit 42 may generate the indication.

When a component such as the video decoder 32, receives or otherwise detects the indication (block 315), if the component is currently processing a configuration (block 320), the component completes the current configuration and processing (block 325). Once the configuration processing is complete, the component may notify the PMU 18, which may in turn responsively remove the power or stop one or more clocks to the component causing the component to power down or otherwise go inactive as described above (block 330). Referring back to block 320, if the component has not started a new configuration, then the component may immediately notify the PMU 18 to power down or otherwise go inactive (block 330).

The video timing and control unit 42 may monitor for the end of the vertical blanking interval. As the end of the vertical blanking interval becomes imminent (block 335), the video timing and control unit 42 may deassert the display inactive indication (block 340). More particularly, in one embodiment, the video timing and control unit 42 may keep track of how much time remains in the vertical blanking interval. When the time remaining reaches a predetermined value, the video timing and control unit 42 may deassert the display inactive indication. Similar to the activation predetermined value, the predetermined value may also be programmed into storage 43, for example.

In response to receiving or otherwise detecting the deasserted display inactive indication (block 345), the PMU 18 may transition a component from an inactive, power down or low power state to an active state (block 350) by powering up or re-starting gated clocks of the component. Operation proceeds as described above in conjunction with the description of block 300.

Figure 4:
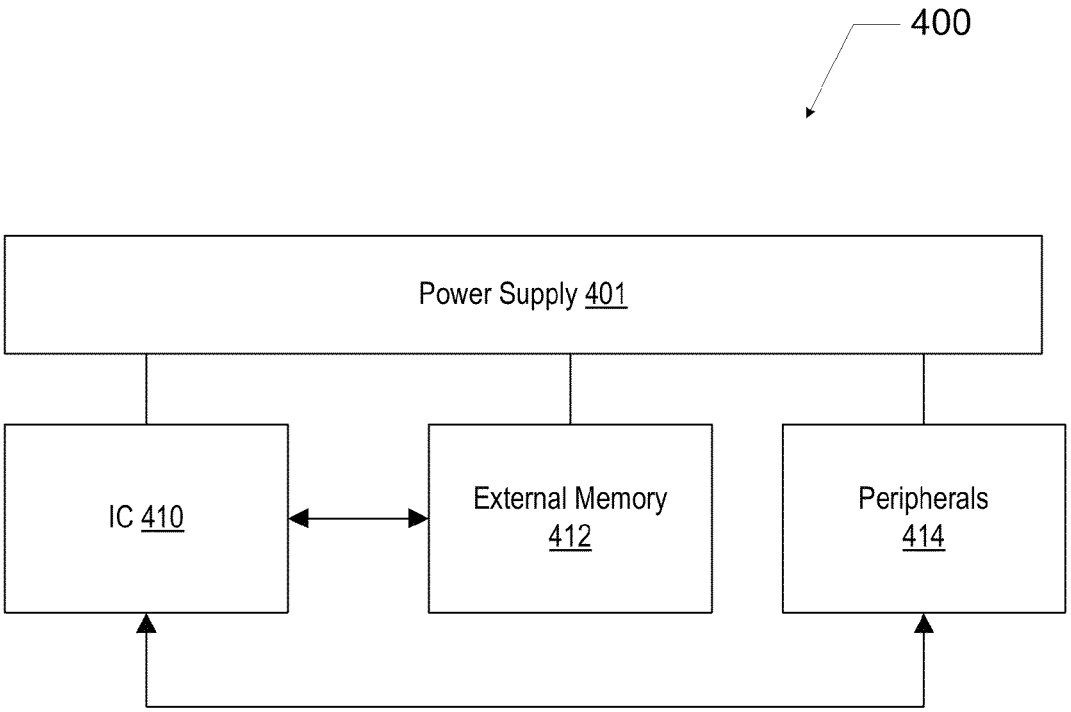
FIG. 4 is a block diagram of one embodiment of a system including the processing system of FIG. 1.

Turning to FIG. 4, a block diagram of one embodiment of a system that includes the processing system 10 of FIG. 1 is shown. The system 400 includes at least one instance of an integrated circuit (IC) 410 coupled to one or more peripherals 414 and an external system memory 412. The system 400 also includes a power supply 401 that may provide one or more supply voltages to the IC 410 as well as one or more supply voltages to the memory 412 and/or the peripherals 414. In some embodiments, more than one instance of the IC 10 may be included (and more than one memory 412 may be included as well). The IC 410 may be representative of the processing system 10 and thus, the SOC described above in conjunction with FIG. 1.

The peripherals 414 may include any desired circuitry, depending on the type of system. For example, in one embodiment, the system 400 may be included in a mobile device (e.g., personal digital assistant (PDA), smart phone, etc.) and the peripherals 414 may include devices for various types of wireless communication, such as WiFi, Bluetooth, cellular, global positioning system, etc. The peripherals 414 may also include additional storage, including RAM storage, solid-state storage, or disk storage. The peripherals 414 may include user interface devices such as a display screen, including touch display screens or multitouch display screens, keyboard or other input devices, microphones, speakers, etc. In other embodiments, the system 400 may be included in any type of computing system (e.g., desktop personal computer, laptop, tablet, workstation, net top, etc.).

The external memory 412 may include any type of memory. For example, the external memory 412 may be in the DRAM family such as synchronous DRAM (SDRAM), double data rate (DDR, DDR2, DDR3, etc.), or any low power version thereof. However, external memory 412 may also be implemented in SDRAM, RAMBUS DRAM, static RAM (SRAM), or other types of RAM, etc. The external memory 412 may include one or more memory modules to which the memory devices are mounted, such as single inline memory modules (SIMMs), dual inline memory modules (DIMMs), etc. Alternatively, the external memory 412 may include one or more memory devices that are mounted on the IC 410 in a chip-on-chip or package-on-package implementation. The external memory 412 may include the memory 12, in one embodiment.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A system comprising:

one or more video processing components; and a display processing unit coupled the one or more video processing components, wherein the display processing unit includes:

one or more processing pipelines configured to generate read requests to fetch stored pixel data from a memory for subsequent display on a display unit;

a timing control unit configured to generate an indication that indicates that the display unit will enter an inactive state;

wherein in response to receiving the indication, one or more of the video processing components are configured to enter a low power state.

2. The apparatus of claim 1, wherein the indication indicates that the display will enter the inactive state within a predetermined amount of time.

3. The apparatus of claim 2, wherein the predetermined amount of time corresponds to a time for a predetermined number of lines of a display data frame to be processed.

4. The apparatus of claim 1, wherein the one or more of the video processing components are further configured to enter the low power state upon completion of processing of a current task.

5. The apparatus of claim 4, wherein the one or more video processing components includes a video decoder configured to complete processing of a current configuration task and to subsequently enter a low power state in response to in response to receiving the indication.

6. The apparatus of claim 4, wherein the one or more video processing components includes a memory to memory pixel processing unit configured to complete processing of a current task and to subsequently enter a low power state in response to receiving the indication.

7. The apparatus of claim 1, wherein the timing control unit is further configured to generate a second indication that indicates that the vertical blanking interval is coming to an end and that the display unit will enter an active state.

8. The apparatus of claim 7, wherein in response to receiving the second indication, the one or more of the video processing components are configured to enter an active state.

9. The apparatus of claim 1, further comprising a power management unit configured to remove an operating voltage from the one or more of the video processing components thereby enabling the one or more of the video processing components to enter the low power state.

10. The apparatus of claim 1, further comprising a power management unit configured to stop one or more system clocks from toggling in the one or more of the video processing components thereby enabling the one or more of the video processing components to enter the low power state.

11. A method for operating a display processing system including one or more video processing components, the method comprising:

a display unit alternatingly entering an active state and an inactive state during operation of the display processing system;

generating read requests to fetch stored pixel data from a memory for subsequent display on the display unit;

generating, by a timing control unit, an indication that indicates that the display unit will enter the inactive state; and one or more of the video processing components entering a low power state in response to receiving the indication.

12. The method of claim 11, wherein the indication indicates that the display will enter the inactive state within a predetermined amount of time.

13. The method of claim 12, wherein the predetermined amount of time corresponds to a time for a predetermined number of lines of a display data frame to be processed.

14. The method of claim 12, wherein the predetermined amount of time is programmable.

15. The method of claim 11, wherein entering the low power state includes clock gating to stop one or more system clocks from toggling within the one or more of the video processing components.

16. The method of claim 11, further comprising the one or more of the video processing components re-entering the active state in response to receiving a second indication that indicates that the vertical blanking interval is coming to an end and that the display unit will enter an active state.

17. A system comprising:

a memory;

a display unit; and an integrated circuit coupled to the memory and to the display unit, wherein the integrated circuit includes:

one or more video processing components;

a display processing unit coupled to the memory and the one or more video processing components, wherein the display processing unit includes:

one or more processing pipelines configured to generate read requests to fetch stored pixel data from the memory for subsequent display on the display unit;

a timing control unit configured to generate an indication that indicates that the display unit will enter an inactive state;

wherein in response to receiving the indication, one or more of the video processing components are configured to enter a low power state.

18. The system of claim 17, further comprising a communication fabric interconnecting the one or more video processing components and the display processing unit, wherein in response to receiving the indication, the communication fabric is configured to enter the low power state.

19. The system of claim 17, wherein the one or more of the video processing components are further configured to enter the low power state upon completion of processing of a current task.

20. The system of claim 17, wherein the indication indicates that the display will enter the inactive state within a predetermined amount of time.

* * * * *